US011541503B2

(12) United States Patent
Yamamoto et al.

(10) Patent No.: US 11,541,503 B2
(45) Date of Patent: Jan. 3, 2023

(54) POLISHING APPARATUS AND POLISHING METHOD

(71) Applicant: Panasonic Intellectual Property Management Co., Ltd., Osaka (JP)

(72) Inventors: Yuji Yamamoto, Osaka (JP); Toru Furushige, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 353 days.

(21) Appl. No.: 16/826,487

(22) Filed: Mar. 23, 2020

(65) Prior Publication Data

US 2020/0324383 A1 Oct. 15, 2020

(30) Foreign Application Priority Data

Apr. 10, 2019 (JP) ..... JP2019-074742

(51) Int. Cl.
*B24B 37/04* (2012.01)

(52) U.S. Cl.
CPC ..... *B24B 37/042* (2013.01)

(58) Field of Classification Search
None
See application file for complete search history.

(56) References Cited

U.S. PATENT DOCUMENTS 6,413,873 B1 * 7/2002 Li ..... B24B 1/04 451/36

FOREIGN PATENT DOCUMENTS

| | | |
|---|---|---|
| JP | 9-167745 | 6/1997 |
| JP | 2000-353677 | 12/2000 |
| JP | 2013-202695 | 10/2013 |
| JP | 2015-013325 | 1/2015 |
| JP | 2018-117058 | 7/2018 |

* cited by examiner

*Primary Examiner* — Long Pham
(74) *Attorney, Agent, or Firm* — McDermott Will & Emery LLP

(57) ABSTRACT

A polishing apparatus is a polishing apparatus polishing a target object formed on a surface of a film-shaped substrate. A polishing apparatus includes: a rotatable polishing tool acting on the target object; a slurry nozzle supplying a polishing slurry; and a polishing stage pressing the polishing tool against the target object. A surface of the polishing stage has an unevenness shape.

12 Claims, 8 Drawing Sheets

POLISHING APPARATUS AND POLISHING METHOD

BACKGROUND

1. Technical Field

The present disclosure relates to a polishing apparatus and a polishing method for polishing and removing a metal film on a surface of a target object using a polishing slurry containing an abrasive.

2. Description of the Related Art

In the related art, in the polishing of metal, plate glass, or the like, for example, a polishing slurry in which water is mixed with a granular abrasive called grinding particles is used. Specifically, the polishing slurry is supplied to a polishing target surface (surface on which polishing is applied), and the polishing target surface is polished while being pressed by polishing means such as a polishing pad. In a case in which it is desired to remove the polishing target surface at a higher speed, polishing using a polishing slurry to which a component having an etching performance is added is generally used, and is called chemical mechanical polishing (CMP). When the polishing slurry having such a chemical action is compared with a polishing slurry having only a simple mechanical action, a polishing rate of a material is significantly decreased when a reaction of chemical components in the polishing slurry is completed.

As an example of a substrate on which a target object is formed, there is a substrate that is processed one by one in a wafer shape, made of silicon, GaN, or the like. Alternatively, there is a substrate that is continuously processed in a form of a film such as polyethylene terephthalate (PET). In a case of a target object formed on a wafer-like substrate, processing is performed by using a polishing pad of which a size is larger than that of the target object, dropping the polishing slurry on the surface of the polishing pad, impregnating the slurry into the polishing pad, and pressing the target object against the surface of the polishing pad. Polishing debris generated at that time is discharged to an outer peripheral portion by a groove shape formed on the surface of the polishing pad (for example, see Japanese Patent Unexamined Publication No. 2015-013325). On the other hand, in a case in which the target object formed on the film-shaped substrate is polished, a method for continuously polishing the surface of the target object while transporting a web by a roll-to-roll system is performed.

SUMMARY

A polishing apparatus according to the present disclosure is a polishing apparatus polishing a target object formed on a surface of a film-shaped substrate.

The polishing apparatus includes: a polishing tool being rotatable and acting on the target object; a slurry nozzle supplying a polishing slurry; and a polishing stage pressing the polishing tool against the target object.

A surface of the polishing stage has an unevenness shape.

A polishing method according to the present disclosure includes: polishing a target object by using the polishing apparatus described above.

DETAILED DESCRIPTIONS

Figure 1:
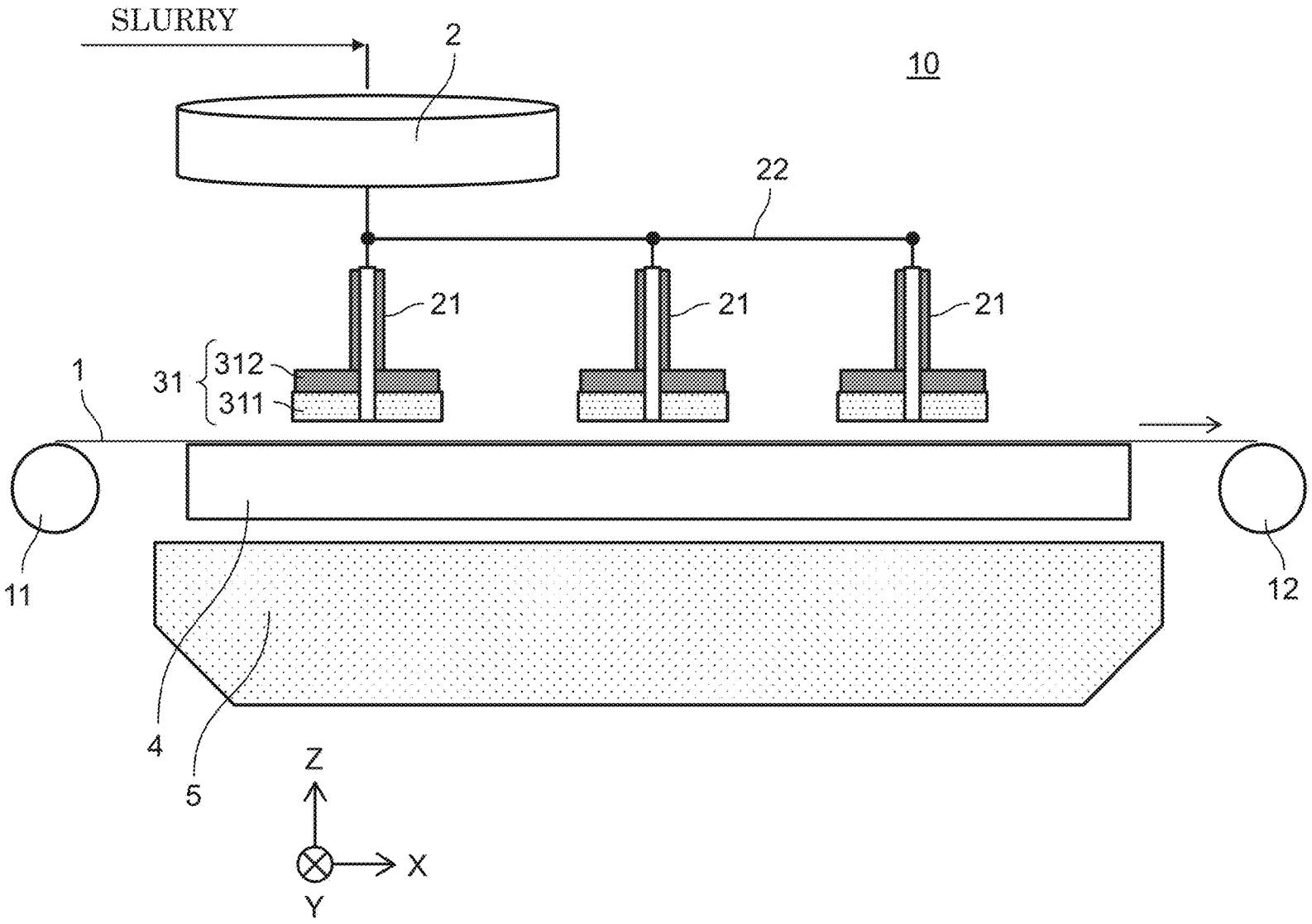
FIG. 1 is a schematic view of a polishing apparatus according to an exemplary embodiment.

In a case in which a continuous film-shaped target object is polished by a method of the related art, polishing is performed with a polishing pad smaller than the target object. In that case, the polishing pad acting on polishing comes into continuous contact with the target object, and it is difficult for the polishing slurry impregnated in the polishing pad to be replaced with new polishing slurry. In particular, in the case of the CMP slurry described above, the polishing rate is decreased due to the chemical reaction. Therefore, polishing cannot be completed in a predetermined time, and product quality may be deteriorated due to a polishing defect. Here, the polishing rate is a thickness (depth) per unit time of an object removed by polishing, and is also referred to as a polishing removal rate or a removal rate.

Hereinafter, a polishing apparatus and a polishing method according to an exemplary embodiment will be described with reference to the accompanying drawings. In the drawings, substantially the same members are denoted by the same reference numerals.

EXEMPLARY EMBODIMENT

FIG. 1 is a schematic view of roll-to-roll polishing apparatus 10 according to the present exemplary embodiment. For convenience, a transport direction of polishing target member 1 (member) having the target object formed on a surface of a film-shaped substrate is defined as an x direction, a vertically upward direction is defined as a z direction, and a directions perpendicular to the x direction and the z direction is defined as a y direction.

Roll-to-roll polishing apparatus 10 according to the present exemplary embodiment is a polishing apparatus continuously polishing the target object formed on the surface of the film-shaped substrate. Polishing apparatus 10 includes rotatable polishing unit 31 (polishing tool) for acting on polishing target member 1, slurry nozzle 21 supplying the polishing slurry, and polishing stage 4 pressing polishing unit 31 against polishing target member 1. A surface of polishing stage 4 has an unevenness shape.

Using polishing apparatus 10, continuous polishing at a high quality and a high polishing rate can be realized.

Film-shaped polishing target member 1 having a polishing target material on its surface is supplied from unwinding roll 11 and collected by winding roll 12. Polishing stage 4 is disposed between unwinding roll 11 and winding roll 12. Polishing target member 1 is transported while sliding on polishing stage 4. Polishing unit 31 is fixed to polishing stage 4. Polishing unit 31 is configured of polishing pad 311 and polishing head 312 with a nozzle. Polishing head 312 is provided with a hole at a center, so that the polishing slurry supplied from an upper portion can flow downward. A plurality of polishing units 31 are disposed at positions parallel to the transport direction (x direction) of film-shaped polishing target member 1.

Figure 2:
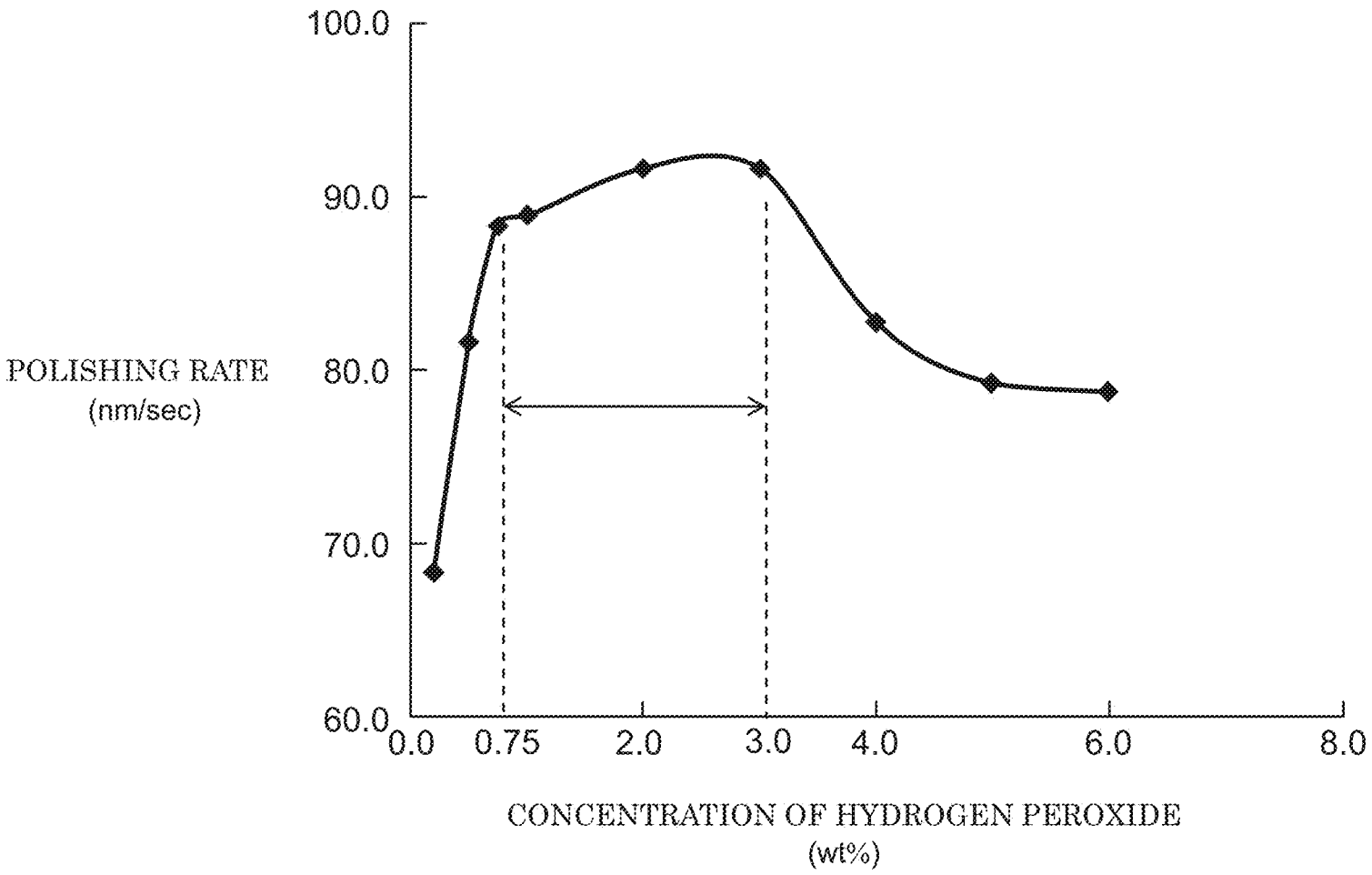
FIG. 2 is a graph of a concentration of hydrogen peroxide and a polishing rate in the exemplary embodiment.

The polishing slurry prepared for polishing is prepared by being mixed with a hydrogen peroxide solution of a concentration of 0.75 wt % or more and 3.0 wt % or less in slurry supply tank 2, and then is supplied to each polishing unit 31 via slurry nozzle 21. In processing of imparting an etching effect, it is desirable to increase the polishing rate as illustrated in FIG. 2 by setting the concentration of the hydrogen peroxide solution in the range of 0.75 wt % or more and 3.0 wt % or less.

The polishing slurry supplied through the hole of polishing head 312 is dropped on the surface of film-shaped polishing target member 1. Polishing unit 31 comes into contact with and pressurizes the surface of film-shaped polishing target member 1, and rotates on the surface of polishing target member 1. In this operation, the polishing target material on the surface of polishing target member 1 is removed by a polishing action of polishing pad 311. The polishing slurry used for polishing flows down from a side surface of polishing stage 4, is dropped on collecting pan 5, and then is collected in a collecting tank (not illustrated).

Hereinafter, each member constituting polishing apparatus 10 will be described.

Polishing Unit (Polishing Tool)

Polishing unit 31 is configured of polishing pad 311 and polishing head 312 with a nozzle. Polishing unit 31 is rotatable about a z-axis as a rotation axis, and acts on film-shaped polishing target member 1. Slurry nozzle 21 is provided in an upper portion of polishing head 312. The polishing slurry supplied via slurry nozzle 21 passes through the hole of polishing head 312 and is dropped on the surface of film-shaped polishing target member 1 on a lower surface of polishing pad 311. That is, the polishing slurry is supplied between polishing pad 311 and film-shaped polishing target member 1 by slurry nozzle 21.

Slurry Supply Tank

The polishing slurry is held in slurry supply tank 2. In slurry supply tank 2, the polishing slurry is prepared by being mixed with the hydrogen peroxide solution of the concentration of 0.75 wt % or more and 3.0 wt % or less.

Polishing Stage

Figure 3:
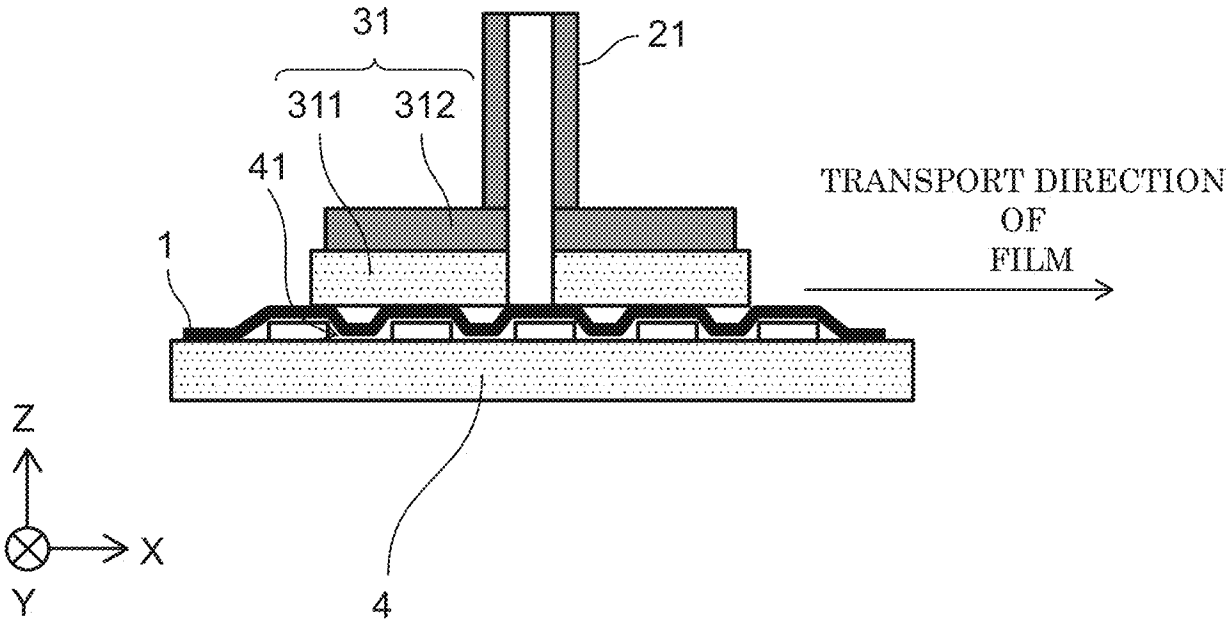
FIG. 3 is a schematic view of a surface of a polishing stage in the exemplary embodiment.

FIG. 3 is a schematic view of a surface shape of polishing stage 4. On the surface of polishing stage 4, unevenness shape 41 having a height difference of 100 μm or more and 300 μm or less formed by etching or blasting is formed. The height difference is a difference between a height of a recess portion in the z direction and a height of a projection portion in the z direction.

It is more preferable if unevenness shape 41 is formed in a stripe shape in a direction (y direction) perpendicular to a traveling direction of film-shaped polishing target member 1 because an entire polishing target surface is uniformly polished.

It is more preferable if an edge of the projection portion of unevenness shape 41 is rounded with a radius of curvature of 20 μm or more, because a rear surface of film-shaped polishing target member 1 is hardly damaged.

It is more preferable if a material of polishing stage 4 is a material such as glass, ceramic, or stainless steel in consideration of reactivity of the polishing slurry.

Figure 4:
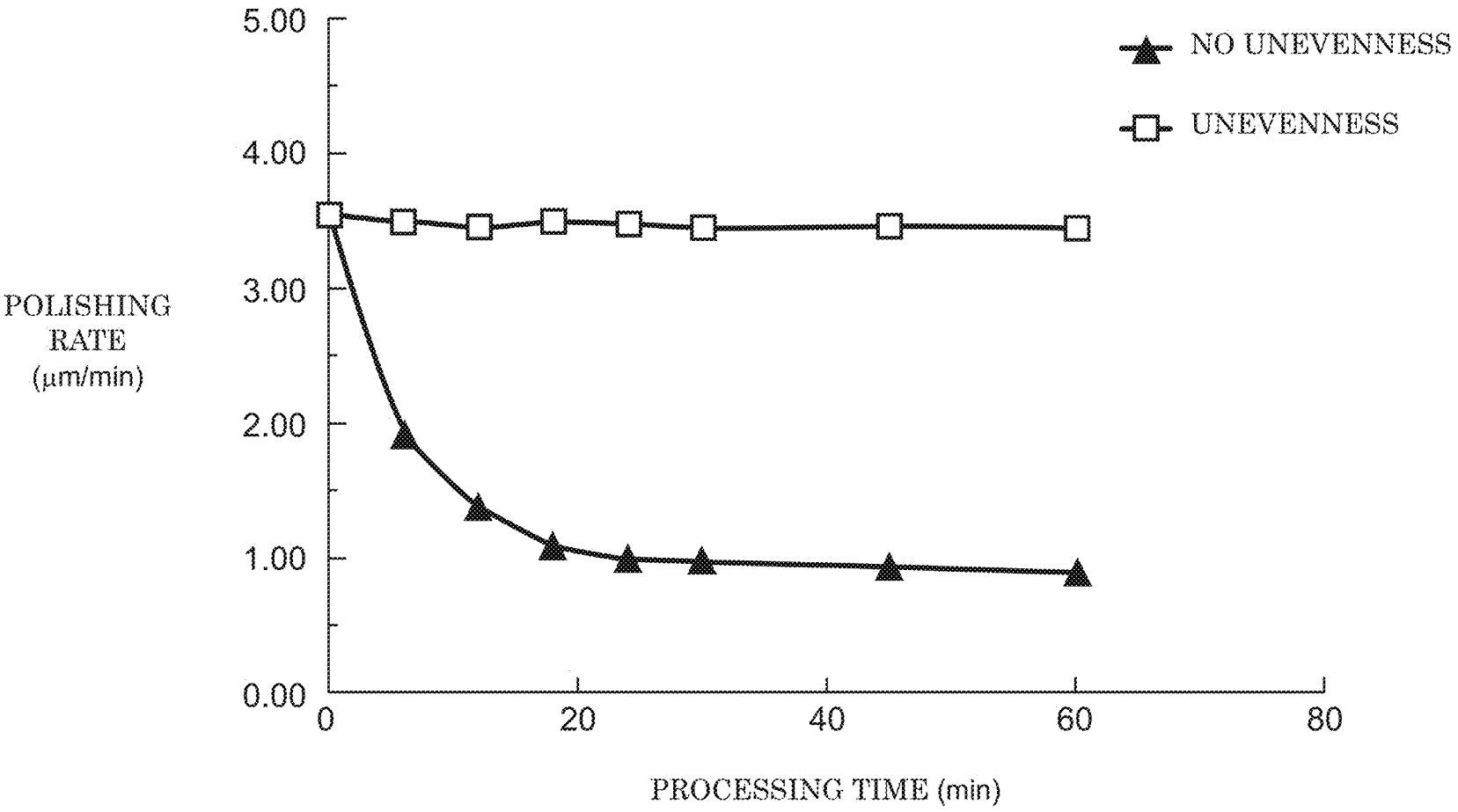
FIG. 4 is a graph illustrating a change in a polishing rate when continuous polishing is performed in the exemplary embodiment.
Figure 5:
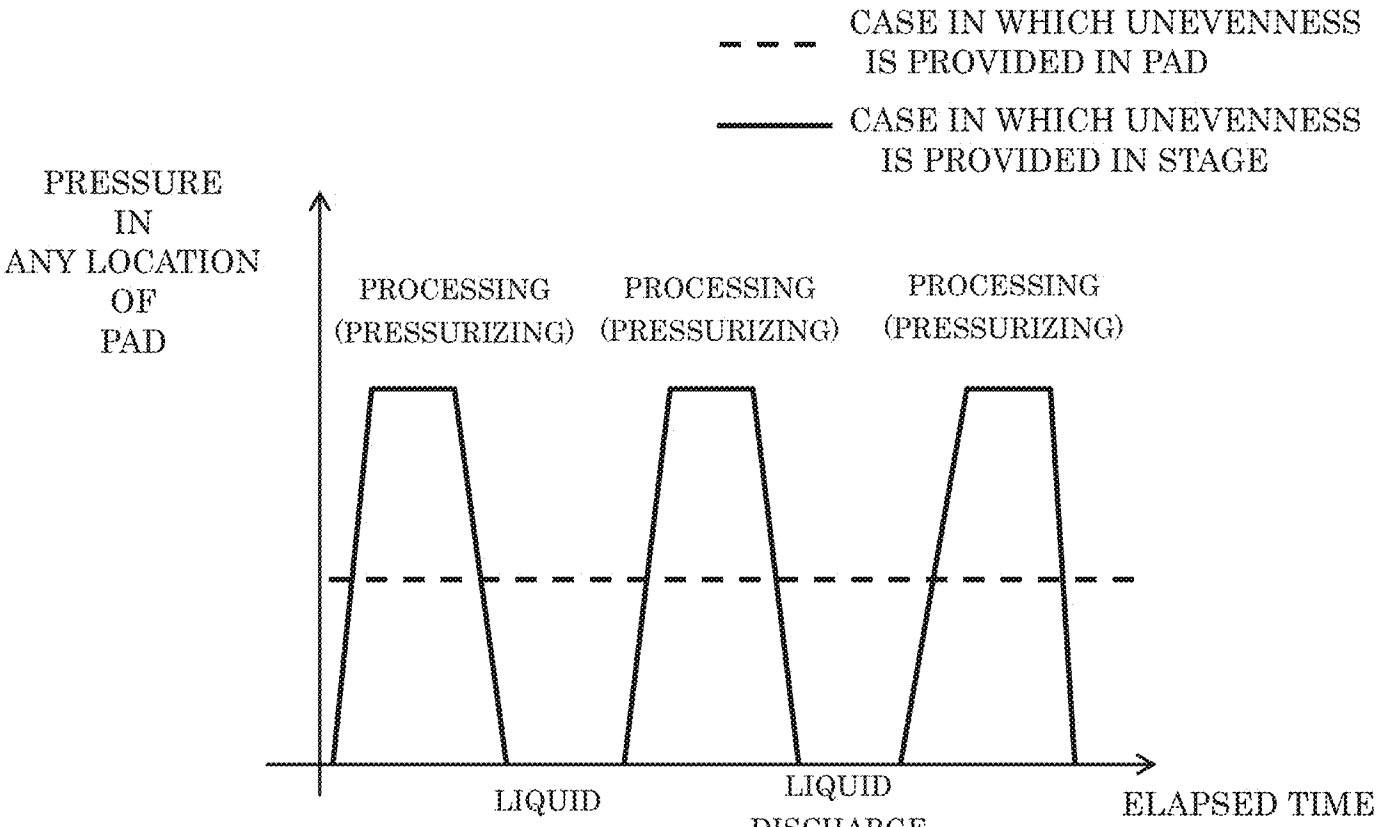
FIG. 5 is an explanatory graph of a change in pressure applied to a surface of a polishing pad in the exemplary embodiment.

FIG. 4 is a graph illustrating a result of continuous polishing of film-shaped polishing target member 1 by the configuration of the present disclosure. A horizontal axis represents an elapsed time of polishing, and a vertical axis represents a polishing rate of a metal film of polishing pad 311. For comparison, the same graph illustrates a case in which no unevenness is formed on the surface of polishing stage 4. In a case in which there is no unevenness shape on the surface of polishing stage 4 (▲), it can be confirmed that the polishing rate decreases after the elapse of time. On the other hand, in a case in which the surface of polishing stage 4 is provided with the unevenness shape (□), it can be confirmed that the polishing rate does not significantly decrease even after the elapse of time. FIG. 5 is an explanatory graph of a change in pressure applied to the surface of the polishing pad in the present exemplary embodiment. As illustrated in FIG. 5, the pressure applied to the surface of the polishing pad fluctuates by providing unevenness on a polishing stage side. Therefore, an effect can be obtained that the used slurry impregnated in the polishing pad is positively discharged. On the other hand, in a case in which the unevenness is provided on a polishing pad side in the related art, the pressure applied to the surface of the polishing pad cannot be fluctuated.

Figure 6:
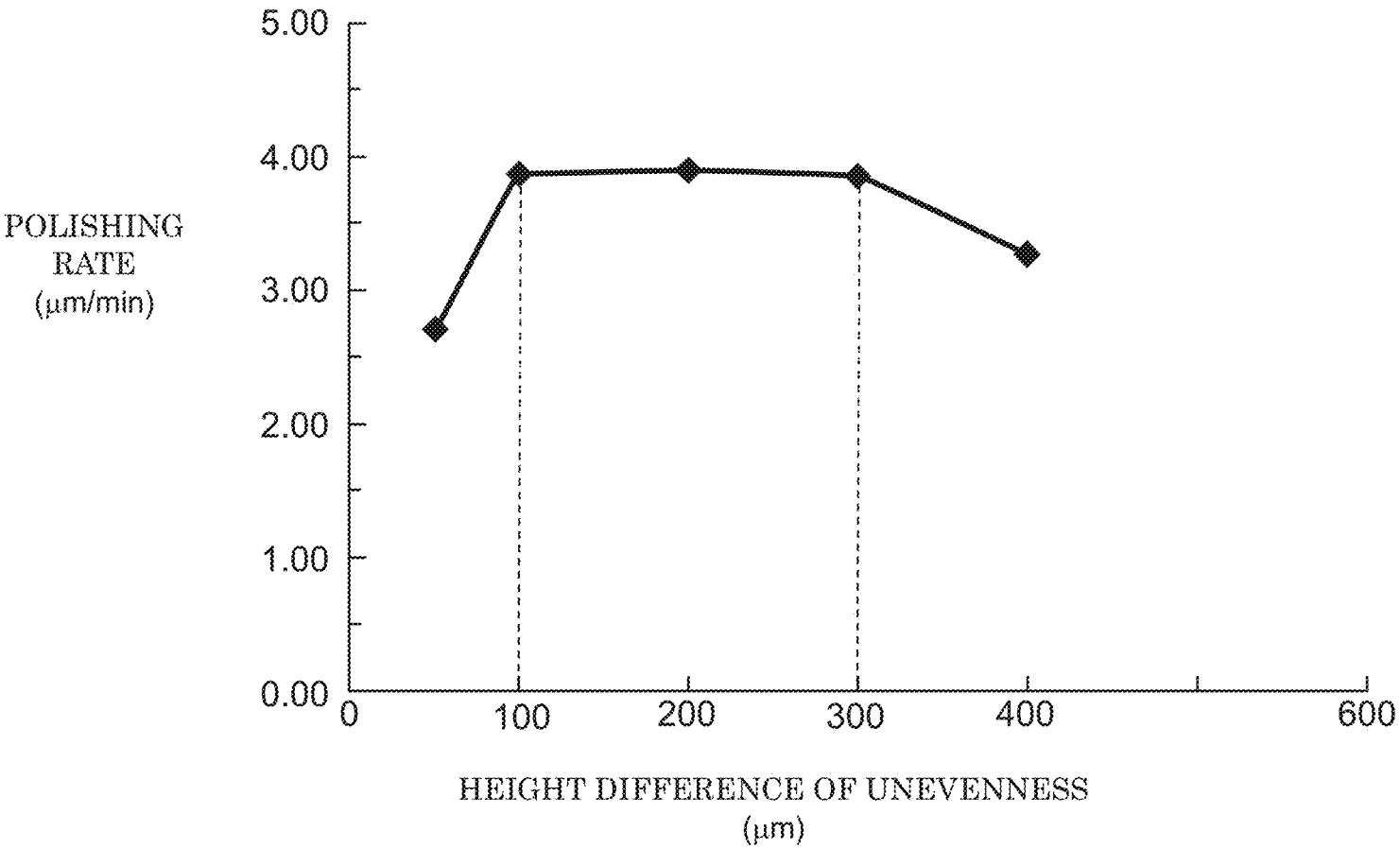
FIG. 6 is a graph illustrating a change in polishing rate in a case in which a height difference of unevenness on the surface of the polishing stage is changed in the exemplary embodiment.

FIG. 6 is a graph illustrating a result of the polishing rate in a case in which a design of the unevenness shape in a height direction is changed. A horizontal axis represents the height difference of the unevenness, and a vertical axis represents the polishing rate of the metal film of polishing pad 311. In a case in which the height difference of the unevenness is less than 100 μm, the polishing rate decreases. This is presumably because the pressure is not sufficiently released, a pressing state is continued, and the polishing slurry, which is still impregnated on the surface of polishing pad 311, is not discharged. On the other hand, in a case in which the height difference of the unevenness is higher than 300 μm, the polishing rate is also decreased. This is presumably because a large gap is generated between polishing pad 311 and the recess portion, and new polishing slurry supplied from the center portion of polishing head 312 passes through the recess portion of the polishing stage, but cannot come into contact with polishing pad 311, and the polishing slurry cannot be absorbed by polishing pad 311. Therefore, it is preferable that the height difference of the unevenness of the unevenness shape formed on the surface of polishing stage 4 be 100 μm or more and 300 μm or less.

It is preferable that the height difference of the unevenness of the unevenness shape be uniform over the entire area of polishing stage 4 in order to suppress variations in polishing. However, in order to efficiently discharge the polishing slurry impregnated in the surface of polishing pad 311, the height difference of the unevenness may be changed in a lower portion of polishing pad 311. More specifically, the height difference of the unevenness of the unevenness shape abutting against a peripheral portion of polishing pad 311 is lower than the height difference of the unevenness of the unevenness shape abutting against the center portion of polishing pad 311, and thereby the polishing slurry discharged from the surface of polishing pad 311 can be efficiently discharged to the outside of the pad.

Figure 7:
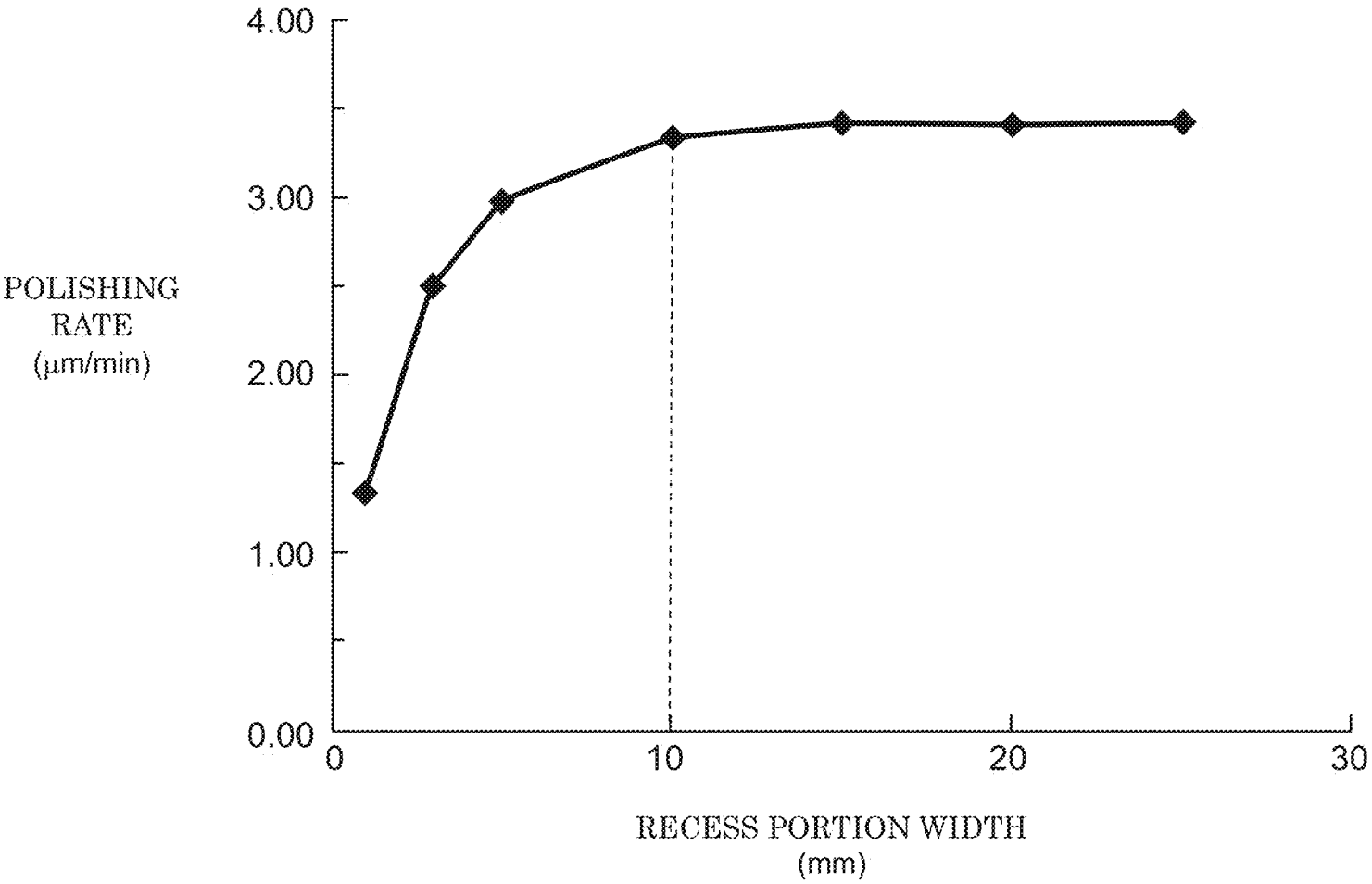
FIG. 7 is a graph illustrating a change in polishing rate in a case in which a recess portion width on the surface of the polishing stage is changed in the exemplary embodiment.

FIG. 7 is a graph illustrating a result of a case in which a design of the recess portion of the unevenness shape in the width direction is changed. A horizontal axis represents the recess portion width, and a vertical axis represents the polishing rate of the metal film of polishing pad 311. In a case in which the recess portion width is less than 10 mm, the polishing rate is decreased. This is presumably because a time during which the pressing state of polishing pad 311 is released is short, and the used slurry impregnated in polishing pad 311 is not sufficiently discharged. Therefore, it is preferable that the recess portion width of the unevenness shape be 10 mm or more.

Figure 8:
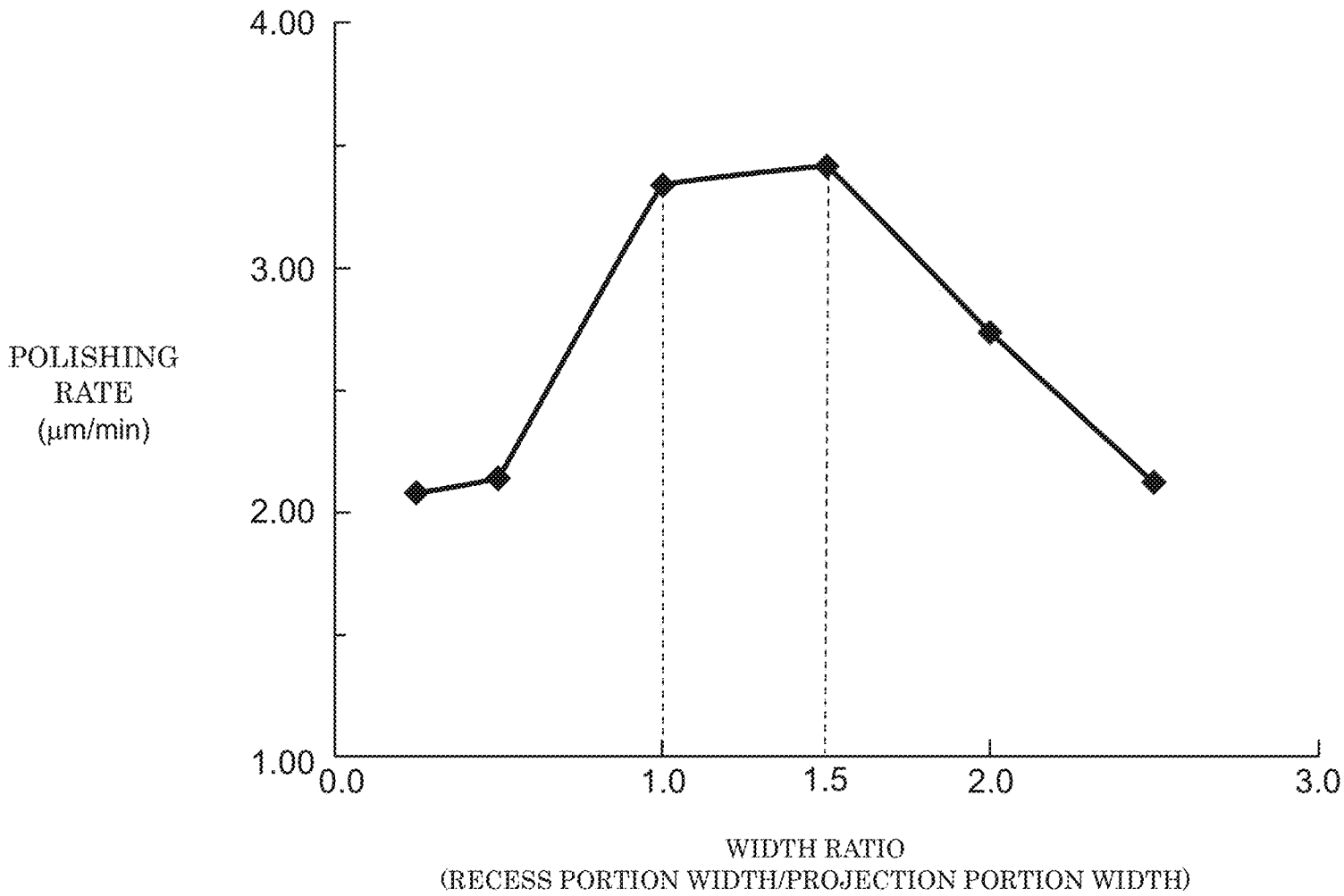
FIG. 8 is a graph illustrating a change in polishing rate in a case in which a width ratio (recess portion width/projection portion width) of the unevenness shape on the surface of the polishing stage is changed in the exemplary embodiment.

FIG. 8 is a graph illustrating a result of examining a ratio of the recess shape to the projection shape in the width direction. A horizontal axis represents a width ratio obtained by dividing the recess portion width by the projection portion width (recess portion width/projection portion width), and a vertical axis represents the polishing rate of the metal film of polishing pad 311. In a case in which the width ratio is lower than 1.0, the polishing rate is decreased. This is because, when the recess portion width is smaller than the projection portion width, the time for discharging the polishing slurry impregnated in polishing pad 311 is shortened, and sufficient slurry discharge and impregnation are not performed. On the other hand, even in a case in which the width ratio is higher than 1.5, the polishing rate is decreased. This is presumably because the recess portion width is larger than the projection portion width, and the projection portion width on which the polishing slurry acts is small even though the used slurry in polishing pad 311 is discharged and impregnated, and thereby the chemical action on the slurry is not fully used. Therefore, it is preferable that the width ratio of the unevenness shape be 1.0 or more and 1.5 or less.

It is preferable that the width ratio of the unevenness shape be uniform over the entire area of polishing stage 4. However, in a case in which a polishing amount is different between polishing target member 1 passing through the center portion of polishing pad 311 and polishing target member 1 passing through the end of polishing pad 311, for example, in a case in which polishing pad 311 has a circular shape, it is preferable that the width ratio of the unevenness shape be changed within the range, which is described above, in the lower portion of polishing pad 311. More specifically, it is preferable that the width ratio of the unevenness shape abutting against the peripheral portion of polishing pad 311 be larger than the width ratio of the unevenness shape abutting against the center portion of polishing pad 311. Since a peripheral speed is high in the outer peripheral portion of polishing pad 311, the polishing rate can be stabilized over the entire surface of polishing pad 311 by increasing the width ratio.

The present disclosure includes an appropriate combination of any of the various examples described above, and the effects of each example can be obtained.

As described above, the polishing apparatus according to the first aspect of the present disclosure is a polishing apparatus that continuously polishes a target object formed on a surface of a film-shaped substrate, the polishing apparatus includes:

a rotatable polishing tool acting on the target object, a slurry nozzle supplying a polishing slurry, and a polishing stage pressing the polishing tool against the target object, a surface of the polishing stage has an unevenness shape.

In the polishing apparatus according to a second aspect, in the first aspect, a concentration of a hydrogen peroxide solution of the polishing slurry may be 0.75 wt % or more and 3.0 wt % or less.

In the polishing apparatus according to a third aspect, in the first or second aspect, the unevenness shape may have a height difference of 100 μm or more and 300 μm or less.

In the polishing apparatus according to a fourth aspect, in the third aspect, an edge of a projection portion of the unevenness shape may be rounded with a radius of curvature of 20 μm or more.

In the polishing apparatus according to a fifth aspect, in the third or fourth aspect, the unevenness shape may be formed in a stripe shape in a direction perpendicular to a traveling direction of the target object.

In the polishing apparatus according to a sixth aspect, in any one of the first to fifth aspects, in the unevenness shape, a recess portion width may be 10 mm or more, and a width ratio of the unevenness shape (recess portion width/projection portion width) may be in a range of 1.0 or more and 1.5 or less.

In the polishing apparatus according to a seventh aspect, in the third or fourth aspect, the polishing stage may be formed of at least one type selected from the group consisting of ceramic, glass, and stainless steel.

A polishing method according to an eighth aspect includes: polishing a target object by using the polishing apparatus according to any one of the first to seventh aspects.

According to the polishing apparatus of the present disclosure, continuous polishing can be realized at a high quality and a high polishing rate.

What is claimed is:

1. A polishing apparatus polishing a target object formed on a surface of a film-shaped substrate, the polishing apparatus comprising:

a polishing tool being rotatable and acting on the target object;

a slurry nozzle supplying a polishing slurry; and a polishing stage pressing the polishing tool against the target object, wherein a surface of the polishing stage has an unevenness shape having a height difference of 100 μm or more and 300 μm or less.

2. The polishing apparatus of claim 1, wherein a concentration of a hydrogen peroxide solution of the polishing slurry is 0.75 wt % or more and 3.0 wt % or less.

3. The polishing apparatus of claim 1, wherein an edge of a projection portion of the unevenness shape is rounded with a radius of curvature of 20 μm or more.

4. The polishing apparatus of claim 1, wherein the unevenness shape is formed in a stripe shape in a direction perpendicular to a traveling direction of the target object.

5. The polishing apparatus of claim 1, wherein in the unevenness shape, a recess portion width is 10 mm or more, and a width ratio of the unevenness shape is in a range of 1.0 or more and 1.5 or less, where the width ratio of the unevenness shape is defined as the recess portion width divided by a projection portion width.

6. The polishing apparatus of claim 1, wherein the polishing stage is formed of at least one type selected from the group consisting of ceramic, glass, and stainless steel.

7. A polishing method comprising:

polishing the target object by using the polishing apparatus of claim 1.

8. A polishing method comprising:

polishing the target object by using the polishing apparatus of claim 2.

9. A polishing method comprising:

polishing the target object by using the polishing apparatus of claim 3.

10. A polishing method comprising:

polishing the target object by using the polishing apparatus of claim 4.

11. A polishing method comprising:

polishing the target object by using the polishing apparatus of claim 5.

12. A polishing method comprising:

polishing the target object by using the polishing apparatus of claim 6.

* * * * *